United States Patent [19]

Erb

[11] 4,340,056

[45] Jul. 20, 1982

[54] NON-AIR-ENTRAINING MIXER/DISPENSER

[75] Inventor: Robert A. Erb, Valley Forge, Pa.

[73] Assignees: The Franklin Institute, Philadelphia, Pa.; RSP Co., Stamford, Conn.

[21] Appl. No.: 230,651

[22] Filed: Feb. 2, 1981

[51] Int. Cl.[3] ..... A61J 1/00

[52] U.S. Cl. ..... 128/272.1

[58] Field of Search ..... 128/272.1, 218 M, 218 D, 128/218 DA; 206/528, 538, 219

[56] References Cited

U.S. PATENT DOCUMENTS 3,058,467 10/1962 Faure ..... 128/218 M X
4,031,892 6/1977 Hurschman ..... 128/272.1 X
4,172,457 10/1979 Choksi et al. ..... 128/272.1
4,226,236 10/1980 Genese ..... 128/218 M

FOREIGN PATENT DOCUMENTS 1309044 12/1962 France ..... 128/218 M

*Primary Examiner*—John D. Yasko
*Attorney, Agent, or Firm*—Lieberman, Rudolph & Nowak

[57] ABSTRACT

A mixer and dispenser is described which thoroughly and quickly mixes a fluid and catalyst without the occlusion of air. The combination mixer/dispenser is in the form of a syringe having a hermetic sealing arrangement including a rubber septum at the dispensing end, which syringe converts from a mixer to a dispenser by the simple use of a rigid spacer.

6 Claims, 2 Drawing Figures

NON-AIR-ENTRAINING MIXER/DISPENSER

BACKGROUND OF THE INVENTION

It is often necessary in the bacteriological, pharmaceutical, surgical and the like arts to thoroughly mix chemicals, for example, a fluid and a catalyst, in such a manner as to avoid any air entrainment. This invention is directed to such an apparatus for mixing small amounts of fluid and catalyst so as to obviate any air entrainment or contamination of the contents during either the mixing or dispensing, and is an improvement upon the mixer/dispenser described in co-pending application Ser. No. 913,066 filed on June 6, 1978.

It is the object of this invention to provide a simple and easy to use apparatus which performs the dual function of mixing and dispensing fluid without the entrainment of air.

It is another object of this invention to satisfy the foregoing object with a device that is easy to operate, low in cost, and which, therefore, may be disposable.

It is a still further object of the invention to provide an apparatus which satisfies the foregoing objects for a highly viscous fluid.

Still other objects, features, and advantages of this invention will become apparent upon a reading of the detailed specification which follows.

BRIEF DESCRIPTION OF THE DRAWINGS

For a better understanding of the invention, reference is made to the following drawings, taken in conjunction with the specification, in which.

DETAILED DESCRIPTION

Figures 1, 1A, 2:
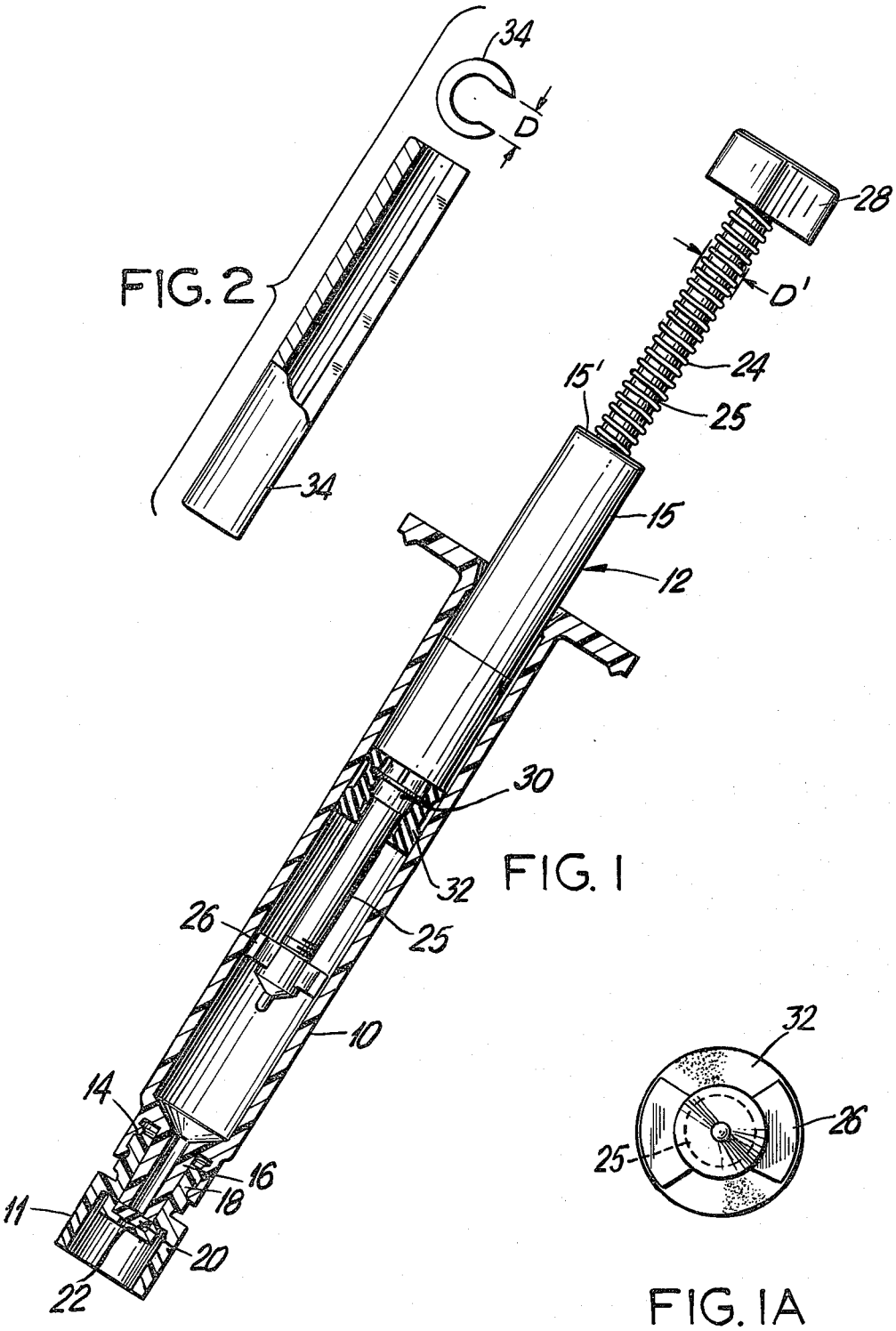
FIG. 1 illustrates a non-air entraining mixer in accordance with the invention.
FIG. 2 depicts an embodiment of a rigid spacer for converting the mixer to a dispenser.

FIG. 1 shows the non-air-entraining mixer, including a cylindrical body 10 into which a reciprocating plunger assembly 12 is slidably mounted.

Plunger assembly 12 comprises a shaft 25 with piston 15 slidably mounted on shaft 25 between a knob 28 on the outer end of shaft 25 and a mixing head 26 on the inner end of shaft 25. Spring 24 is mounted upon that portion of shaft 25 which extends through and beyond piston 15, and acts in a conventional manner to urge piston 15 away from shaft knob 28. The inner portion of shaft 25 extends through a seat 30 formed at the inner end of piston 15, on which an elastomeric sealing member 32, which has sealing functions on both shaft 25 and body 10, is snap fit. With the plunger assembly 12 removed from cylinder 10, piston 15 will normally seat upon mixing head 26 (FIG. 1A). The presence of fluid in the cavity, however, will position the piston dependent upon the amount of fluid in the cylinder, e.g., as shown in FIG. 1.

The delivery end of the mixer/dispenser has a Luer fitting or cap 11, which is a commercially available quick-connect utilizing helical threads 14 to interlock male and female mating cones 16 and 18 of the syringe and cap, respectively. Luer fitting 11 is modified to accommodate, in the recess at the end of the female cone 18, a Teflon-faced rubber septum 20 closing the aperture 22, which is located at the extreme end of the Luer cone. When Luer fitting 11 is mounted on cylindrical body 10, it forms a hermetic closure penetrable by a hypodermic needle through the septum for the injection of the catalyst.

The mixer will preferably be supplied pre-filled with a fluid which has been de-gassed in a conventional manner in a vacuum chamber and then packaged with spring 24 in a compressed state (not shown). With this arrangement, piston 15 will be riding firmly atop the fluid in the cylinder, and the mixing head 26 will be at the cylinder extreme near the delivery end.

Packaging under spring compression permits a positive internal pressure of spring against piston, thereby preventing air leakage inwardly during shipment or storage. This is particularly important where the storage is at low temperature and where there is generally some fluid contraction.

When the material is needed, a catalyst (or any fluid to be mixed) is added to the interior of the cylinder by injection from a hypodermic needle inserted through septum 20.

Mixing is now accomplished by reciprocating the mixing head 26 back and forth, giving the shaft 28 a quarter turn upon each reciprocation. The knob may be square to facilitate this action. FIG. 1A is a detail of the mixing head 26, and as will be appreciated, reciprocation with the 90° rotation causes a thorough mixing of the catalyst and fluid. During the mixing, sealing member 32 provides a seal between shaft 25 and piston 12 through which it is moving. When mixing the fulids, spring 24 acts as a constant return and the friction of piston to cylinder fit (which includes sealing member 32) maintains the piston in position.

Once the mixing has been concluded (the amount of mixing would generally be determined empirically for any given fluid catalyst system), the mixer may be converted to a dispenser. For this purpose the shaft knob 28 is regressed until the mixing head 26 seats on the outer surface of sealing member 32. Rigid spacer 34, shown in FIG. 2, is forced over the spring 24. Illustratively, spacer 34 is a split cylinder, fabricated of aluminum, polycarbonate, or other appropriate material, having a length slightly less than the extreme displacement distance between shaft knob 28 and the end surface 15' of piston 15. Upon being seated about the spring and shaft, spacer 34 is retained in position during use by, for example, assuring that split diameter D is slightly less than spring diameter D'.

Now converted, Luer cap 11 is removed from the end of cylinder 10 and pressure on shaft knob 28 will be transmitted to the piston via the spacer. Sealing member 32 will provide the necessary seal so that pressure on the cap will be transmitted directly to the fluid thereby forcing the fluid out of the cylinder end.

I have found that a suitable material for the piston and cylinder components is polypropylene, which is clear and permits visualization of the mixing process which is particularly helpful when the catalyst and fluid are different colors.

It will be appreciated by those skilled in the art that various arrangements and modifications may be made in the embodiments of the invention herein specifically disclosed, all without departing from the spirit and scope of the invention.

I claim:

1. An apparatus for mixing and dispensing fluids without the occlusion of air comprising:

a syringe-type cylindrical body having a reduced portion at one end;

a cap having a hypodermic needle pentrable septum disposed in said cap;

mating means between said reduced portion of said cylindrical body and said cap for hermetically sealing said septum to said reduced cylinder end;

a plunger assembly insertable in the other end of said cylindrical body, said plunger assembly comprising a shaft, a mixing head disposed at one end of said shaft, a knob disposed at the other end of said shaft, a piston reciprocally riding said shaft between said head and knob for hermetically and slidably filling the spacing between said shaft and the cylinder walls, a spring disposed between said knob and said piston and urging said piston towards said mixing head; and spacer means adapted for insertion between said knob and said piston for locking the piston on said shaft, and converting the mixing function to a dispensing function.

2. The apparatus of claim 1 wherein said mating means is Luer-type connection and in which said reduced end portion of said body is conical.

3. The apparatus of claim 1 wherein said spacing means is a split rigid tube dimensioned to snap over said spring.

4. The apparatus of claim 3 in which the split rigid tube has a length slightly less than the distance between the piston and the knob when said piston abuts said mixing head.

5. The apparatus of claim 1 further comprising a single elastomeric member attached to said piston to provide a slidable sealing function against both said shaft and said cylinder walls.

6. In the apparatus of claim 1 in which the cylinder has contained therein a fluid, a method for assuring against the occlusion of air during storage and shipment due to volumetric changes in said fluid comprising:

packaging said apparatus with said spring compressed and said piston riding firmly atop the fluid.

* * * * *